United States Patent [19]

Rizzo

[11] 4,261,144

[45] Apr. 14, 1981

[54] VERTICAL CORNER POST FOR SCREENED-IN ROOM STRUCTURE

[75] Inventor: Michael Rizzo, Massapequa, N.Y.

[73] Assignee: RHW, Inc., Cleveland, Ohio

[21] Appl. No.: 54,849

[22] Filed: Jul. 5, 1979

[51] Int. Cl.[3] ..... E04B 1/347; A47H 3/00

[52] U.S. Cl. ..... 52/63; 52/282; 160/392; 160/395

[58] Field of Search ..... 52/63, 282; 160/392, 160/395, 403

[56] References Cited

U.S. PATENT DOCUMENTS

| | | | |
|---|---|---|---|
| 2,328,928 | 9/1943 | Sherron | 52/282 |
| 2,396,257 | 3/1946 | Fould | 52/282 X |
| 2,639,769 | 5/1953 | Krantz | 160/395 X |
| 2,835,325 | 5/1958 | Gilbert et al. | 160/395 X |
| 3,143,165 | 8/1964 | Lewis et al. | 160/394 |
| 3,382,639 | 5/1968 | Smith et al. | 52/63 X |
| 3,513,608 | 5/1970 | Nagrod | 52/222 X |
| 4,084,360 | 4/1978 | Reckson | 52/63 |

FOREIGN PATENT DOCUMENTS

| | | | |
|---|---|---|---|
| 1007949 | 4/1977 | Canada | 52/63 |
| 2002059 | 7/1971 | Fed. Rep. of Germany | 52/282 |
| 2120904 | 3/1972 | Fed. Rep. of Germany | 52/282 |

*Primary Examiner*—Alfred C. Perham

*Attorney, Agent, or Firm*—Bauer & Amer

[57] ABSTRACT

A vertical corner post for use in constructing a room-bounding wall in which flexible screening and relatively rigid kick panels are vertically held between adjacently-disposed vertical support members.

10 Claims, 6 Drawing Figures

VERTICAL CORNER POST FOR SCREENED-IN ROOM STRUCTURE

The present invention relates to screened-in rooms and more particularly to vertical corner posts for use in constructing a bounding wall thereof.

It is an object of the present invention to provide a singular unitary vertical corner post for supporting flexible screening held between the corner post and adjacently-disposed vertical supports so as to at least partially bound and enclose a screened-in room.

It is another object of the invention to provide a vertical corner post which includes means for supportedly receiving a vertically-disposed kick plate panel.

It is a further object of the invention to provide a vertical corner post configured so that the same may be integrally fabricated as a continuous one-piece member at relatively low cost.

Further objects, features and advantages of the present invention will be more fully appreciated by reference to the following detailed description of presently preferred, but nonetheless illustrative, embodiments in accordance with the present invention when taken in conjunction with the accopanying drawings, wherein.

DETAILED DESCRIPTION OF THE PREFERRED EMBODIMENTS

The present invention broadly relates to enclosed structures wherein a wall bounds and encloses an area to delimit a room or the like. In particular, such structures are commonly utilized in fabricating screened or otherwise substantially closed-in rooms or porches as additions to a home or a commercial building. The room may be built immediately and abuttingly adjacent to the building's exterior so that they share a common wall and accordingly the addition of an enlcosed porch to an existing home or other structure can be accomplished merely by providing room-defining walls as herein described extending outwardly from the building and a roof over the area.

Figure 1:
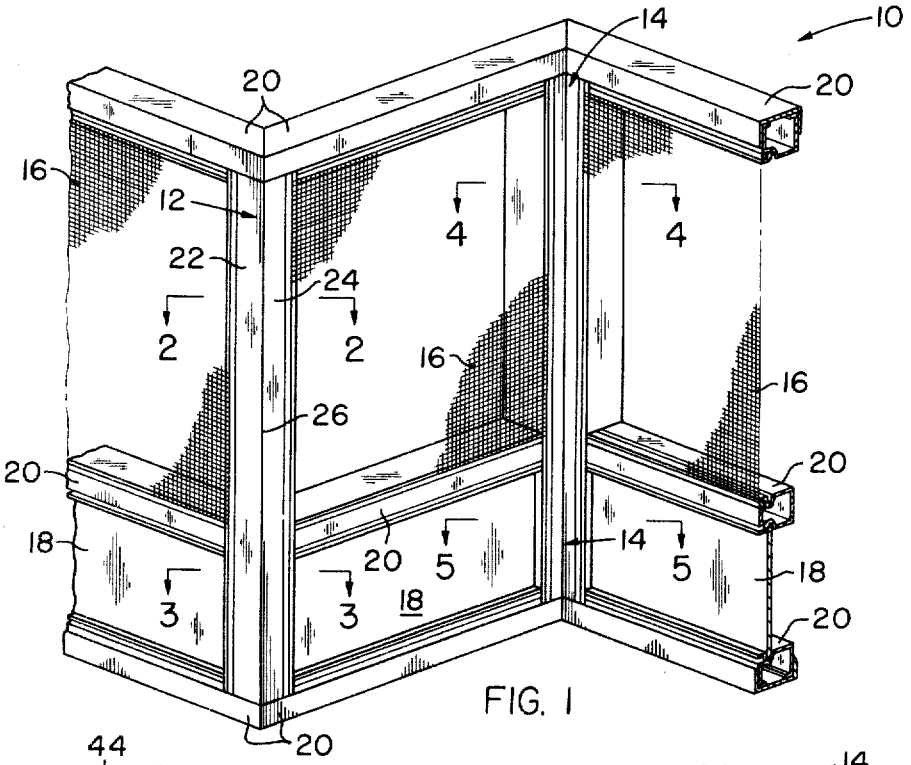
FIG. 1 is an elevated perspective view of a portion of an outer wall bounding a screened-in room structure and including vertical corner posts constructed in accordance with the present invention.

A portion of a room-defining wall intended for such a construction is seen in FIG. 1 and therein designated by the general reference numeral 10. The present invention relates specifically to vertical corner post members for use in fabricating variously angled portions of a room-enclosing wall of the general type illustrated in FIG. 1. Accordingly, the portion of the wall 10 illustrated is shown as angular and convoluted, rather than straight as much as the wall might actually be constructed, so as to facilitate an understanding of the manner in which the inventive corner posts may be employed in a completed room-defining arrangement.

The wall 10 is comprised of spaced-apart vertical support members, such as the corner posts 12 and 14 shown, between which flexible screening 16 and substantially rigid kick plate panels 18 are disposed so as to bound the enclosed area. Various horizontal members individually and collectively designated 20 and forming no part of the present invention are provided at the top and bottom of the wall 10 and between the screening 16 and kick plates 18 to complete and rigidify the overall structure and improve the decorative appearance thereof.

Thus, the wall 10 essentially comprises a lattice or framework of vertically and horizontally-disposed support members between which flexible screening 16 and relatively rigid kick plate panels 18 are vertically held to complete the enclosing wall structure. The specific contribution of the present invention is embodied in the vertical corner posts 12, 14 which enable the construction of angled portions of the wall 10 whereby relatively angularly positioned straight wall portions can be integrally and unitarily joined or connected at corners defined at their points of intersection.

Figure 2:
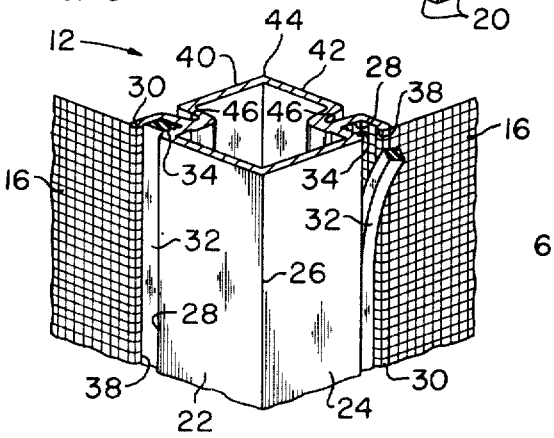
FIG. 2 is an elevated perspective view of a vertical corner post according to the present invention taken generally along the lines 202 in FIG. 1.
Figure 3:
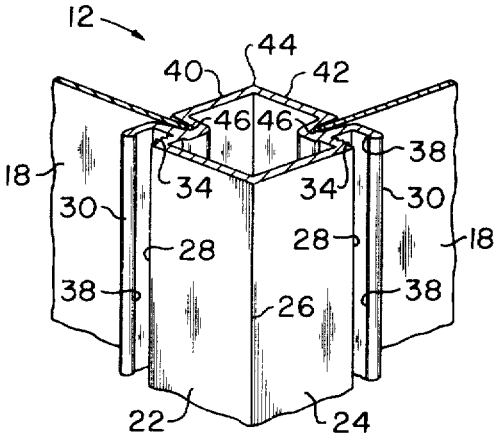
FIG. 3 is an elevated perspective view of the vertical corner post of FIG. 2 taken generally along the lines 303 in FIG. 1.

The vertical corner post 12, shown in detail in FIGS. 2 and 3, is a first embodiment constructed in accordance with the present invention. The post 12 is illustrated as substantially square in cross-sectional configuration although it should be understood that the relative widthwise extents and the angular relations between the intersecting faces thereof may be predeterminately varied from that shown so as to conform to selected design criteria for the wall 10. In any event, the corner post 12 comprises a pair of first or outer wall faces 22, 24 extending for the full length thereof and intersecting along contiguous edges to form an outside corner 26 of the posts 12. Thus, the wall faces 22, 24 and the corner 26 formed therebetween are intended to define an outwardly-disposed corner edge of the wall 10 for use in the manner seen in FIG. 1. Those skilled in the art will recognize that the angular relation at the intersection of the outer wall faces 22, 24—i.e. the angle of the outer corner 26—must be between 180 and 360 degrees. In the substantially square cross-sectional shape of the post 12 shown in the drawing the corner angle is clearly approximately 270° between the wall faces 22, 24.

Each outer wall face 22, 24 carries a recessed, vertically-disposed channel 28 which extends continuously for at least a portion, and preferably for the full length, thereof. The channels 28 are defined in each wall face 22, 24 adjacent and parallel to the lateral edge 30 which lies opposite its outer corner-defining edge. Put another way, each outer wall face 22, 24 is deemed, for purposes of description, to laterally extend from the post corner 26 to its opposite edge 30 and carries a recessed channel 28 defined parallel and immediately adjacent to the edge 30. Thus, in the absence of the channel 28, each face 24, 26 would extend unbroken between its oppositely-disposed lateral edges 26 and 30.

Each channel 28 is, for purposes of illustration, substantially U-shaped in cross-section and is intended to receive an elongated spline 32 of resiliently deformable material for cooperative engagement within and along at least a longitudinally-extending portion of the channel. The shape and size of the spline 32 should substantially conform to that of the receiving channel 28 and the spline is accordingly shown as generally rectangularly shaped so as to achieve a relatively snug fit within and against the interior bounding surfaces of the channel.

To further facilitate the cooperative interengagement of the spline 32 in the receiving channel 28, the latter may be provided with a series of serrations or undulations or ribbing 34 longitudinally-extending along at least one of its interior bounding surfaces. In the embodiment of the post 12 seen in FIGS. 2 and 3 the ribbing 34 is provided on the interior channel surface nearest the post corner 26 and opposite the interior surface which joins or meets the edge 30 of the respective wall face 22 or 24. It should, however, be apparent that the ribbing 34 could be alternatively or additionally provided on others of the interior surfaces of the channel 28.

Figure 6:
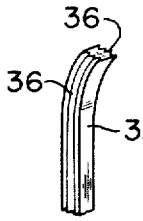
FIG. 6 is an elevated view of a portion of a modified spline construction.

The spline may similarly include corresponding serrations or ribbing on at least one face thereof so as to enable a positive interlocking engagement between the spline and interior channel surfaces at their respective cooperating ribbings. A modified spline 32' which carries serrations or ribbing 36 integrally formed on a pair of oppositely disposed faces thereof is illustrated in FIG. 6. It is not, of course, intended to limit use of the inventive corner post 12 to cooperative engagement with either of the spline members 32 or 32' and accordingly, the application of the reference numeral 32 to each mention of the spline member throughout the remainder of this description is deemed to include a contemplated substitution of the modified spline 32' thereof.

Referring again to FIG. 2, the sheets of flexible screening 16 which are substantially vertically held between the corner post 12 and an adjacently-disposed vertical support member are captured at an edge portion of the screening within the corner post channel 28. A spline 32 is press-fitted into each channel 28 so that the screening is tightly held between the spline and the interior surfaces or faces of the respective channel and there retained against relative movement. The resilient elasticity of the spline 32 and its predetermined shaping and sizing for snug-fitting engagement in the channel 28 are generally adequate to firmly and positively retain the screening as the same is somewhat tautly stretched between adjacent ones of the vertical support members which form the wall superstructure. However, the provision of the serrations or ribbing 34 defined in channel 28, and of corresponding serrations 36 in the spline 32', further inhibits relative slippage of the screening 16 with respect to the mutually engaged spline and receiving channel since the positive locking action of the spline serrations with the cooperating channel serrations causes the screening 16 to be even more tightly and positively held therebetween.

Each channel 28 is further provided with a projecting ridge or rib 38 at its juncture with the edge 30 of the respective wall face 22 or 24. Put another way, the lateral edge 30 of each of the respective wall faces 22, 24 carries an integral edge 38 which extends or projects a short way into the interior of the respective channel 28. The ridge or rib 38 is effective to inhibit inadvertent disengagement of the spline 32 from its engaged position within the channel 28 in the event of a sudden pulling force or the like exerted on the screening since the inward projection of the rib 38 restricts the size of the channel's opening so as to neck or constrict the entry portion thereof. Increased deformation of the resilient spline 32 is consequently required in order to enable the spline to be pressed into, or removed from, cooperative engagement with the channel 28 by reason of the integrally provided rib 38.

The screening 16 is seen to extend outwardly from the corner post 12 and more particularly from edge-captured relation in the channels 28. From its captured edges the screening extends about the interior bounds or surfaces of the channel 28 against which it is pressed and held by the cooperating spline 32 and over the respective projecting ridge or rib 38. The outward extension of the screening 16, in order to provide a decorative and finished appearance of the wall 10, is disposed substantially parallel to the respective wall face 22 or 24 from which the same extends although this relationship is not essential to the practice of the invention. The ridge 38 is preferably smoothly and arcuately configured so that the overlaid passage of the screening around the same does not result in increased wear to or tearing of the screening 16 contiguously overlaying the ridge 38.

Third and fourth wall faces 40, 42 respectively intersect along contiguous lateral edges thereof to form an inner corner 44 of the post 12 disposed diagonally opposite the outside corner 26. These additional or inner wall faces 40, 42 are each laterally connected with a respective one of the first and second wall faces 22, 24 to complete the substantially square cross-sectional configuration of the post 12 shown in the drawing. Thus, the first and third wall faces 22, 40 and the second and fourth wall faces 24, 42 are connected along lateral edges opposite the respective corner-forming edges thereof.

Each of the third and fourth wall faces 40, 42 includes a continuous substantially V-shaped groove or slot 46 vertically-defined therein and disposed generally adjacent the channel 28 provided in the respective adjoiningly-connected wall face 22 or 24. The recessed groove 46 is intended to receive an edge of a relatively rigid kick plate panel 18 so that the kick plate forms at least a portion of the wall 10 between adjacently-disposed vertical and horizontal support members. As best seen in FIG. 3, the V-shaped configuration of the groove 46 is effective to guide a kick plate 18 fully into its interior so that the kick plate is supportedly retained at the rearmost interior portion thereof and against lateral or transverse movement when so held. The narrowest or innermost portion of the groove 46 is accordingly provided with a widthwise dimension substantially conforming to the thickness of the kick plate panel 18 therein received to discourage lateral or transverse movement of the kick plate.

It is preferred that both the spline-receiving channels 28 and the kick plate retaining grooves or slots 46 extend for the entire length of the corner post 12. This enables the post 12 to be continuously and unitarily extruded as a one-piece member and thereafter severed into the discrete lengths required for forming the particular wall 10. Of course, although preferably the channels 28 and grooves 46 each extend continuously for the full length of the post 12, it is intended, as seen in FIG. 1, that neither the screening 16 nor the kick plates 18 be retained in their respective receiving means along the full length of the post. In other words, in a typical installation of the wall 10 the screening 16 will extend for only a portion of the vertical reach or height of the wall 10 while the kick plates 18 will extend for the remainder of its vertical extent. However, either the screening 16 or the kick plates 18 may be utilized to the exclusion of the other along the full vertical extend of the wall 10 should such a design be preferred and use of the inventive corner post 12 is deemed to contemplate an application of this description.

Figure 4:
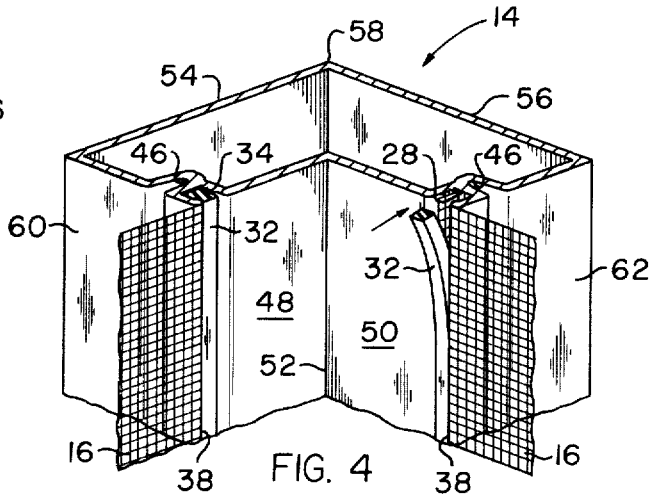
FIG. 4 is an elevated perspective view of another embodiment of a vertical corner post according to the present invention taken generally along the lines 4—4 in FIG. 1.
Figure 5:
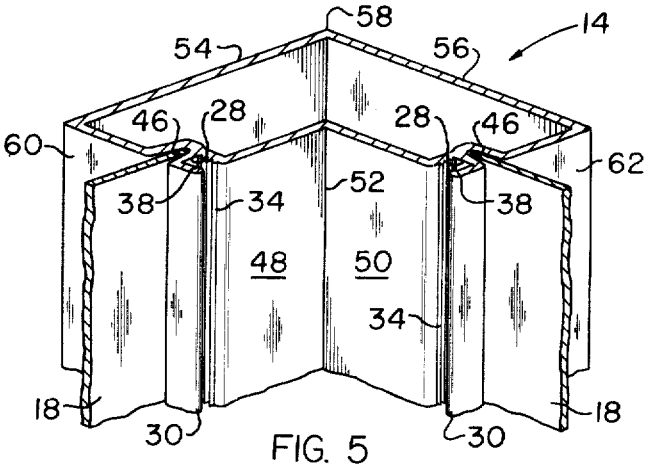
FIG. 5 is an elevated perspective view of the alternative vertical corner post of FIG. 4 taken generally along the lines 5—5 in FIG. 1.

A second embodiment of a corner post, designated by the general reference numeral 14 and which may be similarly utilized in forming a room-bounding wall 10, is seen operatively disposed in FIG. 1 and in greater detail in FIGS. 4 and 5. As there shown, the post 14 is substantially L-shaped and is employed where the required outward-facing corner of the wall 10 necessitates an angle of less than 180 degrees. The previously-described corner post 12, on the other hand, provides an outside corner angle of greater than 180 degrees. It will accordingly be recognized that in constructing a wall 10 the corner posts 12 and 14 are employed in diametrically opposite circumstances; the post 12 provides what might be referred to as an "outside" or larger-than-straight angle while the post 14 forms an "inside" or less-than-straight corner angle for the exterior or outwardly-disposed face of the wall 10. The differing end uses of the corner posts 12 and 14 are clearly illustrated in the wall 10 of FIG. 1.

More particularly, the vertical corner post 14 includes a pair of outer wall faces 48, 50 which intersect along contiguous edges to form the normally outwardly-disposed corner 52. The angular relation of the intersecting wall faces 48, 50 as shown is approximately 90 degress, although the outside corner angle at their contiguous intersection can be predeterminately set between zero and 180 degrees as required by the design of the wall 10. Naturally, since a selective angular variation of the outside corner 52 is contemplated in the practice of the invention, it is not intended that the scope of the invention be limited to a strictly L-shaped cross-sectional configuration although the corner post 14 will in any event include a pair of legs that intersect to define a corner of the wall 10 as shown in FIG. 1.

Each of the wall faces 48, 50 carries a vertically-disposed recessed channel 28 which as shown is identical in configuration and placement to the screen-retaining channel previously described with respect to the corner post 12. Accordingly, any further description of the structural arrangement of the channnels 28 would be redundant and superfluous and is omitted, and the same reference numerals previously employed are utilized in FIGS. 4 and 5 to denote elements of the channels 28 identical with those already described. It is likewise intended that a spline 32 or 32' be cooperatively utilized with the channels 28 of the corner post 14 for the purpose of therein securing flexible screening 16 in the manner illustrated in the drawing and hereinabove described.

A second pair of wall faces 54, 56 similarly intersect along contiguous edges to form a normally inwardly-facing corner 58 of the post 14. Each of the second wall faces 54, 56 is disposed substantially parallel to a respective one of the first wall faces 48, 50 and spaced therefrom by one of a pair of third wall faces 60, 62 which connect the same along lateral edges thereof. Thus, the third wall faces 60, 62 connect the first wall faces 48, 50 to the second wall faces 54, 56 and separate or space apart the respectively parallel first and second wall faces by amounts corresponding to the horizontally-disposed widths of the connecting third wall faces. The third wall faces 60, 62 also serve to complete the closed, substantially L-shaped cross-sectional configuration of the post 14.

A generally V-shaped and vertically-disposed groove or slot 46 is defined in each of the third wall faces 60, 62 adjacent its lateral edge connection with the respective first wall face 48, 50. Again, the configuration and placement of the grooves or slots 46 are intended to be identical with that previously described with respect to the first-described embodiment of FIGS. 2 and 3 and further discussion thereof is accordingly omitted. However, it will be understood that the grooves 46 are intended to receive relatively rigid kick plate panels 18 for supporting the panels between the corner post 14 and an adjacently-disposed vertical support member.

The present invention will accordingly be understood to provide a vertical corner post for use in forming a wall which bounds a screened-in or otherwise enclosed area. In each of the embodiments herein shown and described, provision is included for accommodating either flexible screening or relatively rigid kick plate panels, or a combination of both, between adjacently-disposed vertical support members. The vertical corner posts according to the invention can advantageously be fabricated by continuous extrusion whereby a unitary, one-piece member is economically and efficiently manufactured. Moreover, the continuous extension of both screen-retaining channels and kick plate receiving grooves along the full length of the inventive corner post permits screening and /or kick plates to be vertically positioned or disposed at any desired location along the corner post so that the standardized post configuration described can be employed in constructing a variety of area-bounding walls of widely differing designs.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

What is claimed is:

1. In a screened-in room, at least an elongated vertical corner post including the combination of pair of walls faces extending for the full length of said post and disposed at angles intersecting each other along contiguous edges to form a corner post of said room, flexible screening, elongated channel means defined in each of said angularly disposed wall faces and extending along at least a portion of the length of said post for receiving in said channel means said flexible screening to extend from each said wall face of said post in a direction outwardly from said corner and substantially parallel to said wall face, elongated spline means insertable into and cooperating with said channel means for confining retention of a portion of the screening between said spline means and the interior bounds of said channel means, said post including a second pair of wall faces each intersecting a respective one of said first wall faces at an edge of said respective first wall face remote from said corner-forming edge thereof, a plate, and each of said second wall faces including slot means having an opening defined therein and extending for at least a portion of its length and receiving said plate therein such that said plate is disposed substantially parallel to said screening confined in said channel means.

2. In a screened-in room according to claim 1, said channel means in each said first wall face comprising a substantially U-shaped groove extending along at least a portion of the length of the respective wall face, and said slot means in said second wall faces having a wall common to a wall of said U-shaped groove.

3. In a screened-in room according to claim 2, said channel means further including rib means integral with said U-shaped groove and projecting into the interior thereof for facilitating cooperative retention of said spline means in said groove and corresponding retention of the screening between said channel and spline means.

4. In a screened-in room according to claim 1, said plate being a kick plate, each said slot means having a substantially V-shaped cross-sectional configuration receiving said kick plate in said slot means and for supportedly retaining the same against lateral movement.

5. In a screened-in room according to claim 1, a third pair of wall faces, each intersecting a respective one of said second wall faces at an edge of said respective second wall face opposite its intersection with a respective one of said first wall faces, and said third wall faces intersecting each other along contiguous edges thereof which lay opposite their edges intersecting said second wall faces to form a second corner of said post, said first wall faces contiguously intersecting at an angle of substantially 90° and said third wall faces contiguously intersecting at an angle of substantially 270°.

6. In a screened-in room according to claim 1, said corner post being integrally and unitarily extended as a continuous, one-piece construction.

7. In a unitary extended structure in which flexible screening is held between adjacently disposed vertical support members to bound a substantially enclosed room, one of said support members being a vertical corner post for supporting the screening at a corner of the room, comprising:

pair of vertically elongated first wall faces intersecting along contiguous edges to form a first corner of said post, a pair of vertically elongated second wall faces intersecting along contiguous edges to form a second corner of said post diagonally opposite said first corner, respective ones of said first and second wall faces being joined together along edges thereof opposite their corner-forming edges to complete a substantially rectangular cross-sectional configuration of said post, flexible screening, channel means vertically defined in each of said first wall faces and having an opening extending along the length thereof for receiving and retaining in said channel means an edge portion of flexible screening to be held between said corner post and an adjacently disposed support member, spline means cooperating with said channel means in each said first wall face so that the edge portion of the screening is retained between said spline and channel means and the screening extends outwardly from said channel means opening to an adjacently disposed support member whereby each respective first wall face remains uncovered between said channel means and said first corner by the screening extending outwardly from said channel means, elongated slot means defined in each of said second wall faces, and a plate in said slot extending outwardly therefrom substantially parallel to said screening to an adjacently disposed support member.

8. A vertical corner post according to claim 7, said channel means having a substantially U-shaped cross-sectional configuration, and said slot means having a wall common to a wall of said channel means.

9. In a unitary extruded corner post support member in which flexible screening and a plate may be vertically supported between adjacently disposed like corner post support members so as to bound a substantially enclosed room, a vertical corner post support member for supporting the screening and a a plate at a corner of the room, comprising:

a pair of vertically elongated first wall faces intersecting along contiguous edges to form a first corner of said post, a pair of vertically elongated second wall faces intersecting along contiguous edges to form a second corner of said post such that each of said second wall faces is disposed substantially parallel with and is oppositely outwardly directed relative to a respective one of said first wall faces, a pair of vertically elongated third wall faces, each of said third wall faces connecting a respective one of said first wall faces with the second wall face disposed parallel thereto at edges of said first and second faces opposite their corner-forming edges so as to space apart said respectively parallel first and second wall faces by amounts corresponding to the horizontally disposed widths of said connecting third wall faces, channel means having an opening defined in each of said first wall faces and extending vertically therealong to enable the receipt of flexible screening therein, and slot means having an opening defined in each of said third wall faces to receive and support a plate therein, said openings of said slot and channel means of said connected third and first wall faces each being at substantially right angles to the other and a wall separating said slot and channel means.

10. A vertical corner post according to claim 9, said channel means having a substantially U-shaped cross-sectional configuration, and said slot means having a wall common to a wall of said channel means.

* * * * *